US006758261B2

(12) United States Patent
Ramm-Schmidt

(10) Patent No.: US 6,758,261 B2
(45) Date of Patent: Jul. 6, 2004

(54) APPARATUS FOR HEAT TRANSFER BETWEEN GAS FLOWS

(75) Inventor: Leif Ramm-Schmidt, Kirkkonummi (FI)

(73) Assignee: Oy Casparado AB, Helsinki (FI)

( * ) Notice: Subject to any disclaimer, the term of this patent is extended or adjusted under 35 U.S.C. 154(b) by 0 days.

(21) Appl. No.: 10/343,799

(22) PCT Filed: Aug. 3, 2001

(86) PCT No.: PCT/FI01/00692

§ 371 (c)(1),
(2), (4) Date: Feb. 4, 2003

(87) PCT Pub. No.: WO02/12815

PCT Pub. Date: Feb. 14, 2002

(65) Prior Publication Data

US 2003/0173067 A1 Sep. 18, 2003

(30) Foreign Application Priority Data

Aug. 4, 2000 (FI) ..... 001748

(51) Int. Cl.[7] ..... F28F 7/00
(52) U.S. Cl. ..... 165/46; 165/166
(58) Field of Search ..... 165/46, 166, 170, 165/172

(56) References Cited

U.S. PATENT DOCUMENTS 3,036,369 A * 5/1962 Wilkins ..... 29/890.041
3,678,768 A * 7/1972 Mansour ..... 74/54
3,847,211 A * 11/1974 Fischel et al. ..... 165/166
4,111,659 A * 9/1978 Bowley ..... 422/48
4,411,310 A 10/1983 Perry et al.
4,544,513 A * 10/1985 Otterbein ..... 261/153
4,562,630 A * 1/1986 Larsson ..... 29/890.039
5,469,915 A * 11/1995 Cesaroni ..... 165/171
5,505,256 A * 4/1996 Boardman et al. ..... 165/166
5,927,383 A 7/1999 Ramm-Schmidt
6,032,731 A * 3/2000 Grunditz ..... 165/166

FOREIGN PATENT DOCUMENTS

FR 2 251 793 A1 6/1975
WO WO 91/04451 A1 4/1991
WO WO 98/31529 A1 7/1998

* cited by examiner

*Primary Examiner*—Terrell McKinnon
(74) *Attorney, Agent, or Firm*—Birch, Stewart, Kolasch & Birch, LLP

(57) ABSTRACT

A heat exchanger transfers heat between gas flows principally directed counter current, the walls of the heat exchanger separating the flows from each other being made from flexible film through which the heat transfer takes place. The heat exchange elements are attached to each other by welding so that no rigid side-walls are required. The heat exchanger can be folded especially for packaging, transport and installation.

5 Claims, 2 Drawing Sheets

APPARATUS FOR HEAT TRANSFER BETWEEN GAS FLOWS

This application is the national phase under 35 U.S.C. §371 of PCT International Application No. PCT/FI01/00692 which has an International filing date of Aug. 3, 2001, which designated the United States of America.

BACKGROUND OF THE INVENTION

1. Field of the Invention

The object of the invention is a heat exchanger for transferring heat between gas flowing essentially in counter current, the walls of the heat exchanger separating the flows from each other being made of flexible film, through which the heat exchange takes place.

2. Description of the Related Art

Large amounts of energy are lost in connection of ventilation in buildings and industry. Energy is also lost in connection with the processing of various hot flue and process gases, when heat is not recovered from the gases in a sufficiently efficient manner. A typical example is a drying process, from which moist gases are removed. Large amounts of energy could be recovered especially from these, if it were also possible to utilise the energy released by condensation. This is also significant in the protection of the environment, when substances harmful or hazardous to the environment are removed from the gas flow. The removing of water vapour from a gas flow furthermore reduces the so-called visible environmental nuisance. Problems are caused by high investment costs, especially in a case in which corrosive substances are condensed from the gases, and also by the fact that structures generally available on the market operate according to the so-called cross flow principle so that at most about 60–70% of heat is recovered. Heat exchange structures for large amounts of gas are bulky and heavy, so they are difficult to transport and install.

Available in the market are plastic gas—gas heat exchangers, but they are characterised by having a rigid structure. Most of these operate according to the cross flow principle. Really low cost structures are not available. The introduction of a low cost heat exchanger in the market could considerably increase the recovery of heat in many applications at the same time as it could be possible to take into account environmental requirements relating to air protection in a new way.

The patent specification U.S. Pat. No. 4,411,310 discloses a method for manufacturing a heat exchanger from plastic films by bonding parallel films together at certain intervals. Plastic film pairs thus formed are connected to form a heat exchanger. The heat exchange passageways are formed when air, for example, is led into them. The patent suggests that an expanding element can be placed in the channels keeping the channels open. No permanent deformation occurs in the channels, and the dimensions of the heat exchanger change during expansion. This phenomenon often leads to cumbersome inlet and outlet organs for gases, because such a heat exchanger requires a method by which the shrinking of the element can be controlled in the expansion situation.

The patent specification WO 91/04451 discloses a heat exchanger consisting of films for heat exchange between two air flows. The heat exchanger has a separate wall structure for closing the space outside the channels. The channels are kept open by a support block. Stretching the films continuously when directing a pressurised air flow into the channel will eventually lead to undesired elongation or creep. However, the films are not stretched during the manufacturing step to cause permanent deformation. In addition, the heat exchanger has a spring structure with which tension can be adjusted. This makes the structure heavy and expensive.

The patent specification FI 970227 in the name of the present applicant discloses a heat exchange element for a film evaporator or distiller. The film elements are formed from opposite plastic films which are bonded at selected points one to another to channel the interior of the element. In connection of the manufacture, a permanent deformation is caused in the flexible film forming the heat exchange surfaces of the element by stretching it between the bonding points so that, during the later pressurisation of the element, its interior can be expanded so that it simultaneously retains its vertical and horizontal outer dimensions. The heat exchange element of the patent application FI 970227 is used for transferring heat from the vapour to be condensed inside the elements to the liquid to be evaporated on the outer surfaces of the elements.

The said problems in the heat transfer between two gases can be solved by building a heat exchange apparatus according to the invention operating with the counter current principle from flexible plastic film, the apparatus being herein referred to as "heat exchanger". The separate heat exchange elements of the heat exchanger according to the invention, herein referred to as "element", are built from flexible and thin plastic film.

SUMMARY OF THE INVENTION

The heat exchanger according to the invention is characterised in that the element of the heat exchanger consists of two plastic films and a support film positioned between these films, jointed together so that parallel flow channels are produced; the said channels can be expanded so that the element retains its vertical and horizontal outer dimensions; and in that several elements are connected to form a heat exchanger so that the free edges of the plastic films of adjacent elements are bonded together, whereby a closed space is formed also outside the elements; and in that the gas flow is directed to the interior of the flow channels with a higher pressure than to the exterior for expanding the flow channels.

The thickness of the plastic films used for forming the flow channels is 0.01–0.5 mm, most preferably 0.05–0.1 mm.

The support film is preferably made of a stronger plastic film than the plastic films forming the flow channel. The support film may also be made of some other reinforcing material, such as fibreglass mat or net or woven fabric. The purpose of the support film is to keep the element straight as it is in its unpressurised state and to support the element when gas is blown into the flow channels and the flow channels expand. Due to the support film, the vertical and horizontal outer dimensions of the element are retained unchanged irrespective of whether the flow channels contain gas or not.

In an advantageous embodiment of the invention, the flow channels are formed by attaching the plastic films to the support film by a continuous weld joint, and the part of the plastic film remaining between the joints is stretched so that a permanent deformation takes place in it. Gas directed to the interior of the element can flow from one end of the element to the other in the channels thus formed.

Any method presented, for example, in the patent application FI 970227, or other state-of-the-art method can be used in stretching to deform the plastic film. One such method comprises, for example, heating the plastic film and stretching it simultaneously with the aid of the pressure difference.

The flow channel can also be formed so that flexible plastic is fastened to both sides of the support film in a wavelike manner as in a corrugated board. Further, besides bonding, also spot welds or short linear or wavelike weld joints can be used, whereby a bed-like element is formed in which the flow channels are in contact with each other.

The ends of the elements have an aperture structure, which is herein referred to as "batten", through which gas is directed to flow into or out of the element.

Several elements formed in the way described above are assembled to form a heat exchanger so that the free sides of the flexible plastic films remaining in the free sides of superimposed elements are connected to each other. Thus, a heat exchanger is produced from several superimposed elements, in which also the space outside the flow channels is a closed space.

The arrangement described above reduces the manufacturing costs of the heat exchanger, as no separate side wall is required. Further, due to the flexible structure and the lack of rigid walls, the heat exchanger can be packed into a small space, which facilitates transport and installation, thus also reducing costs.

A substantially similar "batten" as in the ends of the elements is placed between the elements in the end of the heat exchanger formed in the way described above. The gas flow is directed to the external space of the elements or out of the external space of the elements through this batten between the elements.

The elements may be positioned at an optional distance from each other, whereby the external space of the flow channels is larger or smaller, and the elements are arranged either so that they touch each other or so that, even when expanded, they remain separate from each other. This distance can be adjusted, for example, by changing the thickness of the batten. In different layers of the heat exchanger, the flow channels of the elements can be positioned either at corresponding points with respect to each other, or overlapping each other.

The gas flow is directed to the interior of the element with a higher pressure than to the exterior to expand the elements. The gas flows are directed to the heat exchanger preferably from its opposite ends so that the gas flows pass through the heat exchanger essentially in counter current.

The heat exchanger can be installed both in vertical or horizontal positions or in an angle between these positions. If liquid condenses from one of the gas flows, it is preferred to install the heat exchanger in a vertical position and to lead said gas flow into the heat exchanger from the upper end.

The invention is next described in greater detail by an example, referring to the accompanying drawings, in which

DETAILED DESCRIPTION

Figure 1:
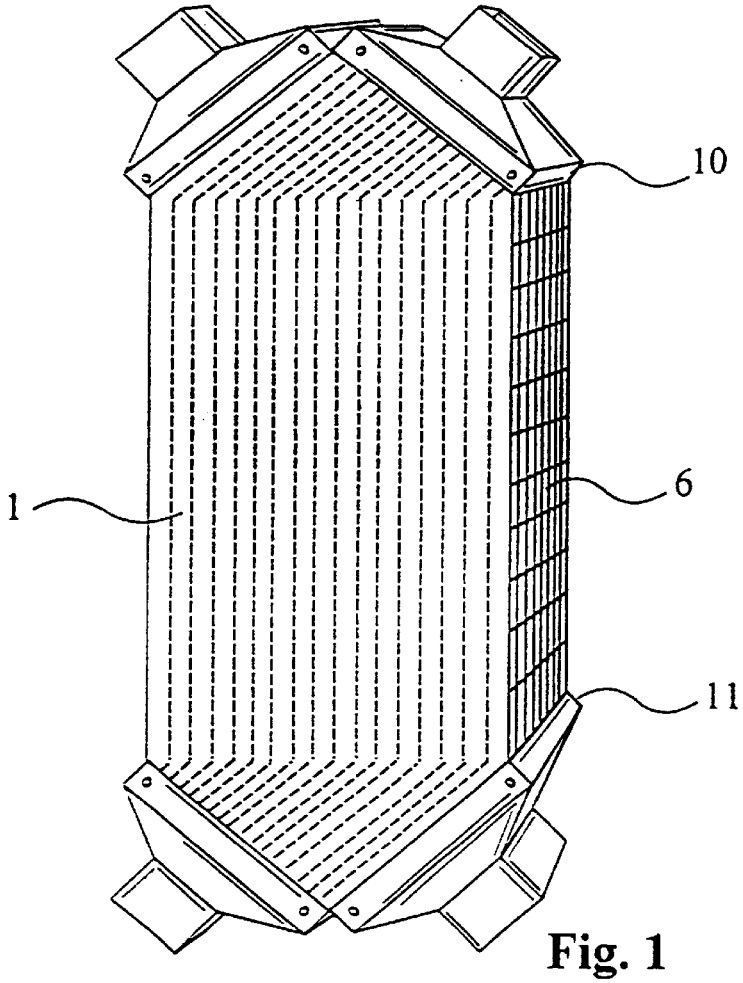
FIG. 1 depicts a heat exchanger according to the invention.
Figure 2:
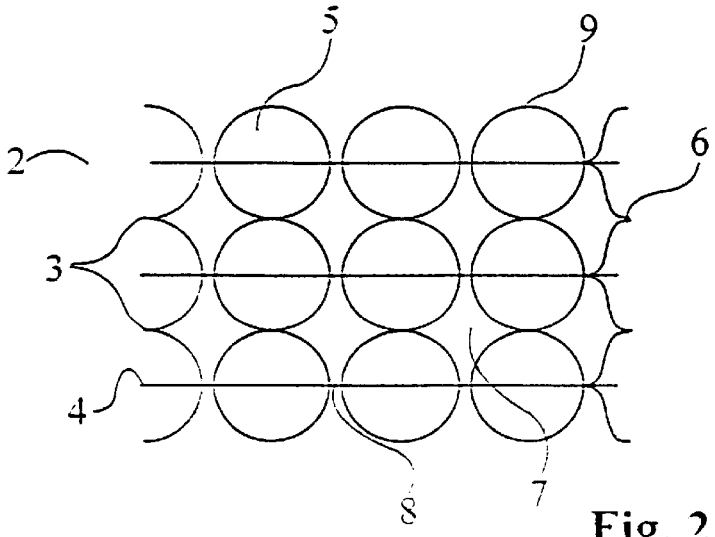
FIG. 2 depicts a cross-section of a heat exchanger according to the invention, the element being expanded.
Figure 3:
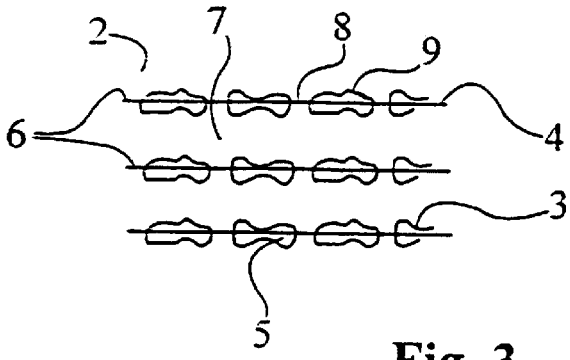
FIG. 3 depicts a cross-section of a heat exchanger according to the invention, the element being unpressurised.

The heat exchanger 1 according to FIG. 1 is made up of several elements 2 in a way shown in FIGS. 2 and 3. The elements 2 consist of two plastic films 3 and a support film 4 positioned between them. The plastic films 3 and the support film 4 are attached to each other so that parallel flow channels 5 are formed. Several elements 2 are connected to form the heat exchanger 1 so that the free edges of the plastic films 3 of adjacent elements 2 form the bond 6. One of the gas flows passes inside the flow channels 5 and the second in the external closed space 7 of the flow channels.

FIGS. 2 and 3 depict an advantageous embodiment of the invention, in which the flow channels 5 are formed by bonding the plastic films 3 to the support film 4 by a continuous weld joint 8, and the part 9 of the plastic film 3 remaining between the joints 8 is stretched so that a permanent deformation takes place in it.

Figure 4:
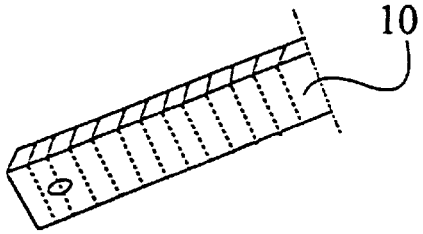
FIG. 4 depicts a batten of a heat exchanger according to the invention for feeding gas.
Figure 5:
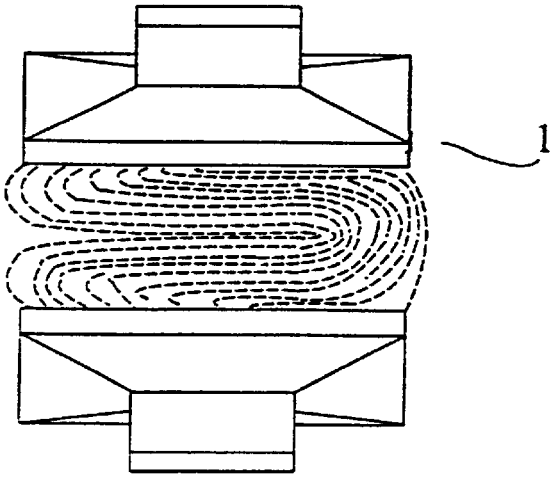
FIG. 5 depicts a heat exchanger according to the invention, folded for transport and installation.

The ends of the elements 2 are provided with an aperture structure or batten 10, the structure of which is shown in FIG. 4. Gas is directed to flow into or out of the element 2 through the batten 10. When assembling the heat exchanger 1, an aperture structure 11 substantially similar to the batten 10 is placed between the elements 2, and the second gas is directed to flow into or out of the external closed space 7 of the elements with the aid of this aperture structure 11.

If liquid condenses from the second gas flow, it is preferred to install the heat exchanger 1 in a vertical position according to FIG. 1 and to lead said gas flow to the interior from the upper end of the heat exchanger 1, whereby the condensing water is removed from the lower end of the heat exchanger 1.

The heat exchanger according to the invention can be used in numerous applications, in which heat transfer is required between two gas flows, for example in the process industry. Heat recovery from flue gases and various drying processes can be given as examples of such applications; it is thus possible to recover water vapour and acids condensing from the gases and their heat content. The heat exchanger according to the invention can further be utilised in connection with ventilation of buildings. One special application of the heat exchanger according to the invention is heating or cooling gas by hot or cold liquid flowing on the outer surface of the element. Gas flowing inside the element passes then preferably counter current from below upwards.

It is evident for a person skilled in the art that the various embodiments of the invention are not limited to those presented above by way of example, but they may vary within the accompanying claims.

What is claimed is:

1. A heat exchanger for transferring heat between gas flows directed principally counter current, which comprises:

walls separating the flows from each other being made of flexible film, through which the heat transfer takes place; and at least one element of the heat exchanger comprising two plastic films and a support film positioned between these films, said films being connected to each other, thus producing parallel flow channels which can be expanded so that the element retains its vertical and horizontal outer dimensions, wherein several of the elements are connected to form the heat exchanger so that free edges of the plastic films of adjacent elements are bonded together, whereby a closed space is formed also outside the elements, and in that the gas flow is directed to an interior of the flow channels with a higher pressure than to exterior for expanding the flow channels, and the heat exchanger can be folded especially for packaging, transport or installation.

2. The heat exchanger according to claim 1, wherein the flow channels are formed by bonding the plastic films to the support film by a continuous weld joint, and a part of the plastic film remaining between the joints is stretched so that a permanent deformation takes place in it.

3. The heat exchanger according to claim 1, wherein the flow channels are formed so that the plastic film is fastened in a wavelike manner to both sides of the support film.

4. The heat exchanger according to claim 1, wherein the flow channels are formed so that the plastic films are attached to each other by spot welds or a discontinuous weld joint and they have been positioned so that they form parallel flow channels which are in contact with each other.

5. The heat exchanger according to claim 1, wherein ends of the element are provided with an aperture structure or batten, through which gas is led to flow into or out of the element, and that, when assembling the heat exchanger, an aperture structure substantially similar to the batten is positioned between the elements, and the second gas is led to flow into or out of an external closed space of the elements with the aid of said aperture structure.

* * * * *

UNITED STATES PATENT AND TRADEMARK OFFICE

CERTIFICATE OF CORRECTION

PATENT NO. : 6,758,261 B2
DATED : July 6, 2004
INVENTOR(S) : Ramm-Schmidt

It is certified that error appears in the above-identified patent and that said Letters Patent is hereby corrected as shown below:

Title page,
Item [73], Assignee, change "Oy Casparado AB, Helsinki (F1)" to -- Hadwaco Technologies Oy, Helsinki (F1) --

Signed and Sealed this

Nineteenth Day of April, 2005

JON W. DUDAS
*Director of the United States Patent and Trademark Office*